United States Patent [19]

Schroeder

[11] Patent Number: 4,570,611

[45] Date of Patent: Feb. 18, 1986

[54] POSITIVE DAMPER ADJUSTMENT DEVICE AND METHODS OF MAKING AND USING THE SAME

[76] Inventor: Albert Schroeder, 23 Rollings Hills, St. Louis County, Mo. 63033

[21] Appl. No.: 590,359

[22] Filed: Mar. 16, 1984

[51] Int. Cl.[4] ..... F23L 3/00

[52] U.S. Cl. ..... 126/288

[58] Field of Search ..... 126/286, 292, 288, 290, 126/285 R, 312, 289; 294/9.13, 53.5

[56] References Cited

U.S. PATENT DOCUMENTS

| | | | |
|---|---|---|---|
| 1,024,508 | 4/1912 | Guy | 126/288 |
| 1,105,651 | 8/1914 | Guy | 126/288 |
| 1,454,538 | 5/1923 | Donley | 126/288 |
| 1,698,234 | 1/1929 | Lawrence | 126/288 |
| 1,987,074 | 1/1935 | O'Brien | 126/288 |
| 2,130,851 | 9/1938 | Le Baron | 126/288 |
| 3,773,029 | 11/1973 | Kent | 126/288 |

FOREIGN PATENT DOCUMENTS

| | | | |
|---|---|---|---|
| 128100 | 6/1919 | United Kingdom | 288/ |

*Primary Examiner*—James C. Yeung

[57] ABSTRACT

The present invention is a positive damper adjustment to be used in conjunction with a conventional fireplace which is provided with a flue damper controlled by a pivotally mounted handle wherein a handle grasping bracket is threadably mounted on an elongated threaded member disposed rotatably in a fireplace bracket provided with mounting means pivotally mounted to the frame of the fireplace and a handle operably mounted on said elongated threaded member.

1 Claim, 3 Drawing Figures

POSITIVE DAMPER ADJUSTMENT DEVICE AND METHODS OF MAKING AND USING THE SAME

BACKGROUND OF THE INVENTION

Conventional techniques for controlling the flue damper in the typical fireplace generally involve a pivotally mounted handle which opens and closes the damper. Because of the arcuate travel of the handle a simple device for continuous adjustment has not been available.

It is contemplated herein that a threaded member disposed within a threaded aperture in a pivotally joined linkage mounted to the frame of the fireplace will allow continuous adjustment of the flue opening.

SUMMARY

It is therefore an object of the present invention to provide a Postive Damper Adjustment device which comprises an elongated threaded member, rotably mounted in a threaded aperture in housing member which is pivotally connected to a bracket member operably connected to the fireplace frame, with handle attachment means mounted at one end of said elongated member and crank handle means mounted at the other end.

An object of the present invention is to provide such a device which allows continuous positive adjustment of the arcuately travelling flue handle.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein like numerals refer to like parts throughout, and in which;

DETAILED DESCRIPTION OF THE INVENTION

Figures 1, 2, 3:
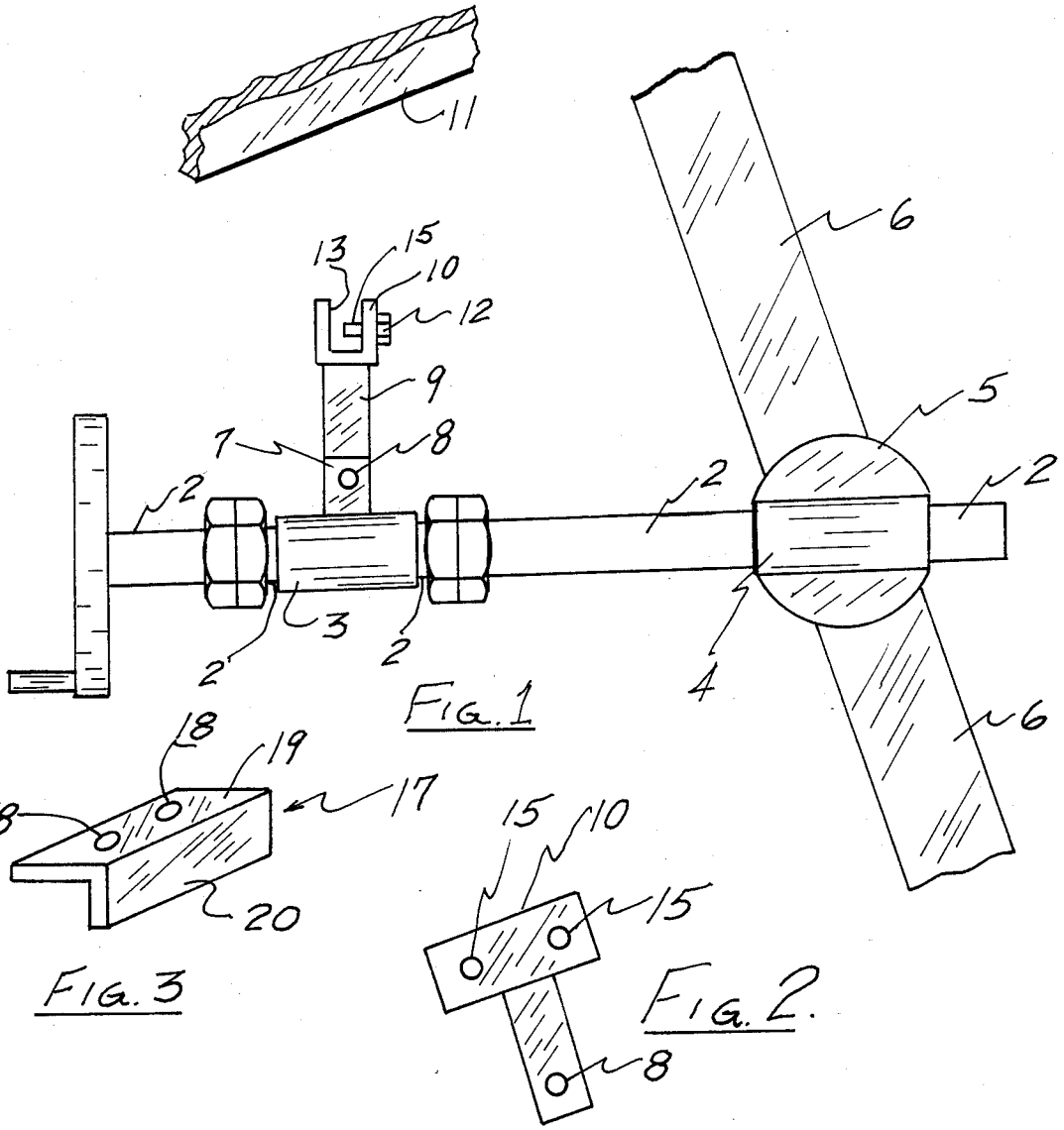
FIG. 1 is a perspective view of a Positive Damper Adjustment device constructed in accordance with and embodying the present invention.
FIG. 2 is another view of the bracket used in the device shown in FIG. 1.
FIG. 3 is an alternate mounting angle iron to use with the frame in FIG. 1.

Referring now in more detail and by reference characters to the drawings which illustrate practical embodiments of the present invention, FIG. 1 is a perspective view of a Positive Damper Adjustment device, 1, construction in accordance with, used in and embodying the present invention.

As shown in FIG. 1, positive damper adjustment device, 1, comprises elongated threaded member, 2, housing member, 3, clamp member, 4, provided with clamp, 5, clamped to flue handle, 6, with housing member, 3, provided with flange, 7, pivotally mounted by means of fastener, 8, to bracket, 9, provided with channel member, 10, adapted to fit on fireplace frame, 11, and secured thereto by fasteners, 12, while frame, 11, is disposed in channel, 13. Crank handle, 14, is attached to and rotates elongated threaded member, 2, which continuously moves flue handle, 6, in its arcuate travel. Also shown in FIG. 1 are a pair of split nuts, unnumbered, mounted on elongated threaded member, 2, with one split nut being disposed between housing member, 3, and clamp, 4, and the other split nut being disposed between housing member, 3, and crank handle, 14. Crank handle, 14, may be rotated using knob, 16. Another view of bracket, 9, is shown in FIG. 2 which illustrates the threaded apertures, 15, into which fasteners, 12, are disposed.

In the event the fireplace is not provided with a frame, 11, then a simple angle iron, 17, may be used by attaching portion, 19, to the wall with fasteners portion, 20, to serve as a substitute for frame, 11.

It should be understood that changes and modifications in the form, construction, arrangement, and combination of the Positive Damper Adjustment device and methods of making and using the same may be made and substituted for those herein shown and described without departing from the nature and principle of my invention.

Having thus described by invention, what I claim is new and desire to secure by United States Letters Patent is:

1. A positive damper adjustment device for use with a fireplace flue provided with an arcuately travelling damper handle comprising, a housing member, an elongated threaded member rotatably mounted in said housing member, clamp means rotatably mounted on proximate one end of said elongated member, a pair of split nuts mounted on said elongated member and disposed proximate each end of said housing member, handle means rotatably mounted proximate the other end of said elongated threaded member, bracket means pivotally mounted to said housing member, such pivotal mounting allowing pivotal motion about an axis transverse to the axis of said elongated member thereby allowing motion toward and away from such damper handle.

* * * * *